US008371591B2

(12) United States Patent
Hwongbo

(10) Patent No.: US 8,371,591 B2
(45) Date of Patent: Feb. 12, 2013

(54) DISK FOR CONTROLLING AN ANGLE OF BINDING IN SNOWBOARD

(76) Inventor: Seok Kun Hwongbo, Seoul (KR)

( * ) Notice: Subject to any disclaimer, the term of this patent is extended or adjusted under 35 U.S.C. 154(b) by 494 days.

(21) Appl. No.: 12/602,999

(22) PCT Filed: Mar. 19, 2008

(86) PCT No.: PCT/KR2008/001552

§ 371 (c)(1),
(2), (4) Date: Dec. 3, 2009

(87) PCT Pub. No.: WO2008/153266

PCT Pub. Date: Dec. 18, 2008

(65) Prior Publication Data

US 2010/0171277 A1 Jul. 8, 2010

(30) Foreign Application Priority Data

Jun. 15, 2007 (KR) ..... 10-2007-0058842

(51) Int. Cl.
*A63C 9/20* (2006.01)

(52) U.S. Cl. ..... 280/14.24; 280/620

(58) Field of Classification Search ..... 280/14.24, 280/620

See application file for complete search history.

(56) References Cited

U.S. PATENT DOCUMENTS 5,577,755 A * 11/1996 Metzger et al. ..... 280/607
5,584,492 A * 12/1996 Fardie ..... 280/14.22
5,586,779 A * 12/1996 Dawes et al. ..... 280/14.24
5,667,237 A * 9/1997 Lauer ..... 280/607
5,782,476 A * 7/1998 Fardie ..... 280/14.24
5,791,678 A * 8/1998 Perlman ..... 280/618
5,868,416 A * 2/1999 Fardie ..... 280/607
5,947,508 A * 9/1999 Graf et al. ..... 280/616
5,984,325 A * 11/1999 Acuna ..... 280/14.24
6,062,584 A * 5/2000 Sabol ..... 280/607
6,189,899 B1 * 2/2001 Carlson ..... 280/14.22
6,203,051 B1 * 3/2001 Sabol ..... 280/607
6,234,494 B1 * 5/2001 Gien ..... 280/14.24
6,318,749 B1 * 11/2001 Eglitis et al. ..... 280/607
6,450,511 B1 * 9/2002 LaVoy ..... 280/14.22
6,467,794 B1 * 10/2002 De France ..... 280/607
6,575,489 B1 * 6/2003 White ..... 280/613
6,945,544 B2 * 9/2005 Feurer et al. ..... 280/14.22
6,994,370 B2 * 2/2006 Sabol ..... 280/618
7,063,346 B2 * 6/2006 Elkington ..... 280/618
7,090,228 B2 * 8/2006 Reynolds ..... 280/14.24
7,168,710 B1 * 1/2007 Hennebry ..... 280/14.24
7,334,810 B2 * 2/2008 Holzer et al. ..... 280/618
7,390,010 B2 * 6/2008 Elkington et al. ..... 280/618
7,416,191 B2 * 8/2008 Yoshino ..... 280/14.22

(Continued)

FOREIGN PATENT DOCUMENTS

DE 200 00 947 U1 4/2000
DE 696 23 509 T2 5/2003

*Primary Examiner* — Jeffrey J Restifo
(74) *Attorney, Agent, or Firm* — Christopher Paul Mitchell

(57) ABSTRACT

Disclosed is a disk for adjusting the angle of a snowboard binding. A base plate of the snowboard binding has a toothed gear formed at an inner periphery of a center opening thereof. As toothed gear formed at outer ends of disk gears included in the disk are engaged with the toothed gear of the base plate of the snowboard binding when a disk lever provided at the center of the disk is rotated clockwise or counterclockwise, the disk can be mounted to the base plate of the snowboard binding, so as to control the angle of the snowboard binding.

2 Claims, 7 Drawing Sheets

U.S. PATENT DOCUMENTS 7,490,859 B2 * 2/2009 Coing ..... 280/817
8,052,157 B2 * 11/2011 Holzer ..... 280/14.24
8,132,818 B2 * 3/2012 Cunningham et al. ..... 280/14.24
8,167,321 B2 * 5/2012 Cunningham et al. ..... 280/14.24
2005/0051978 A1 * 3/2005 Sabol ..... 280/14.24
2010/0102522 A1 * 4/2010 Kloster et al. ..... 280/14.24
2010/0171277 A1 * 7/2010 Hwongbo ..... 280/14.24

* cited by examiner

[Fig. 1]
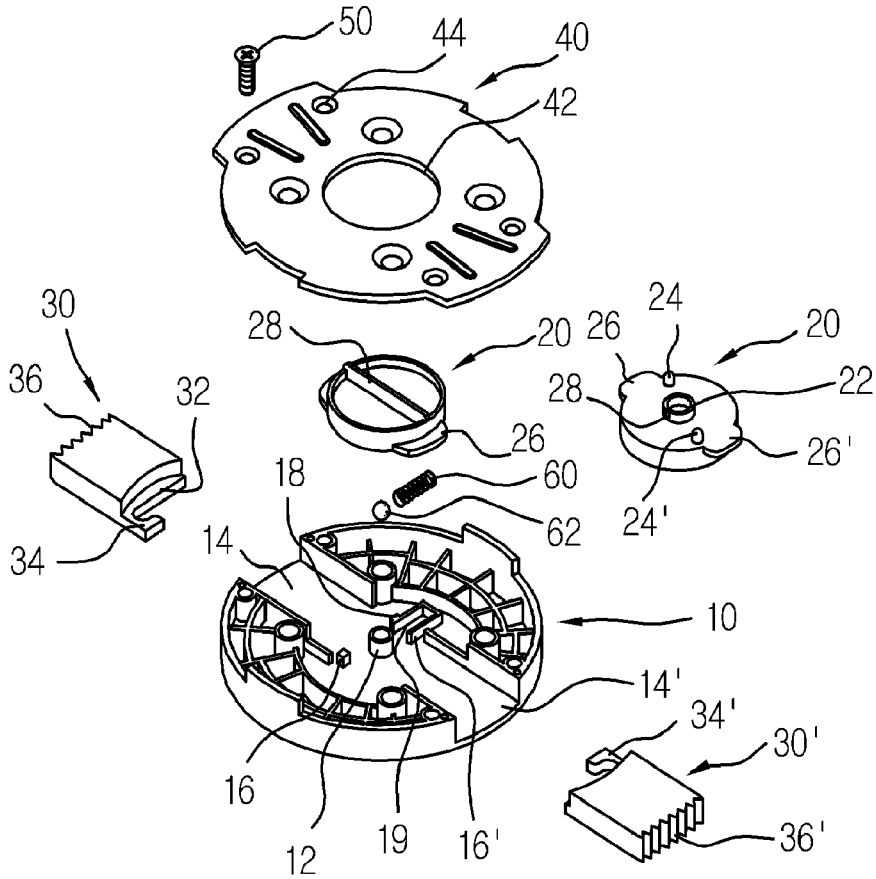
[Fig. 2]
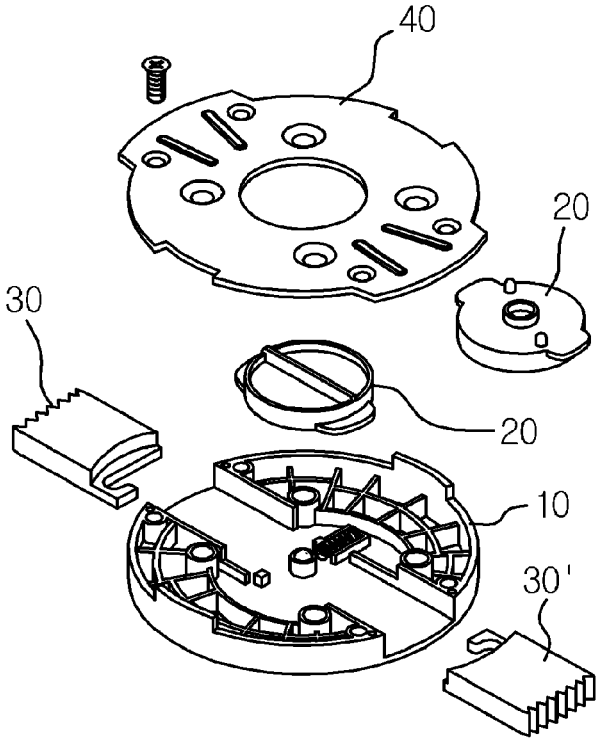

[Fig. 3]
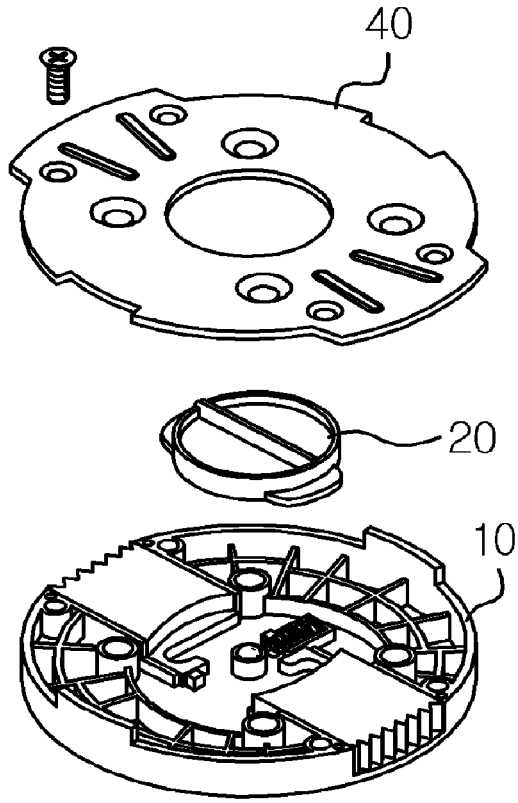
[Fig. 4]
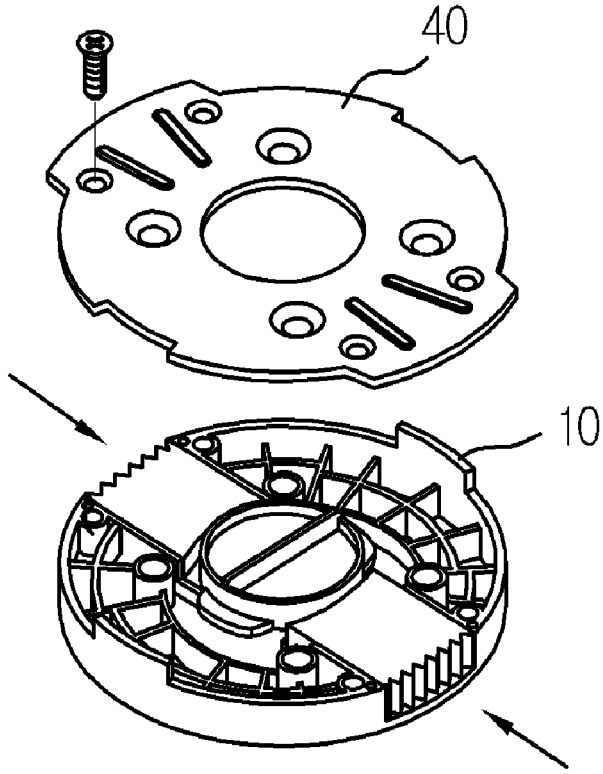

[Fig. 5]
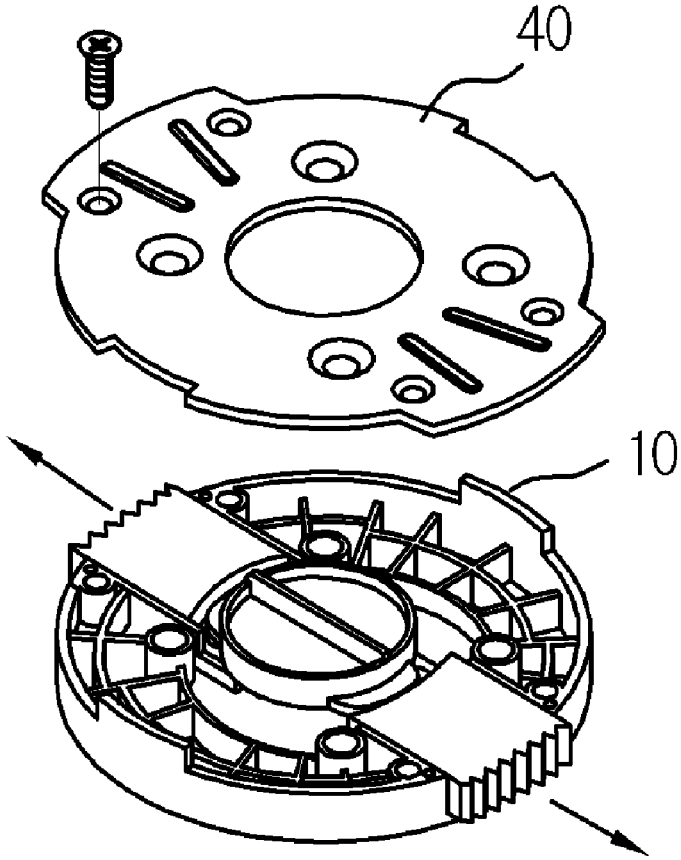
[Fig. 6]
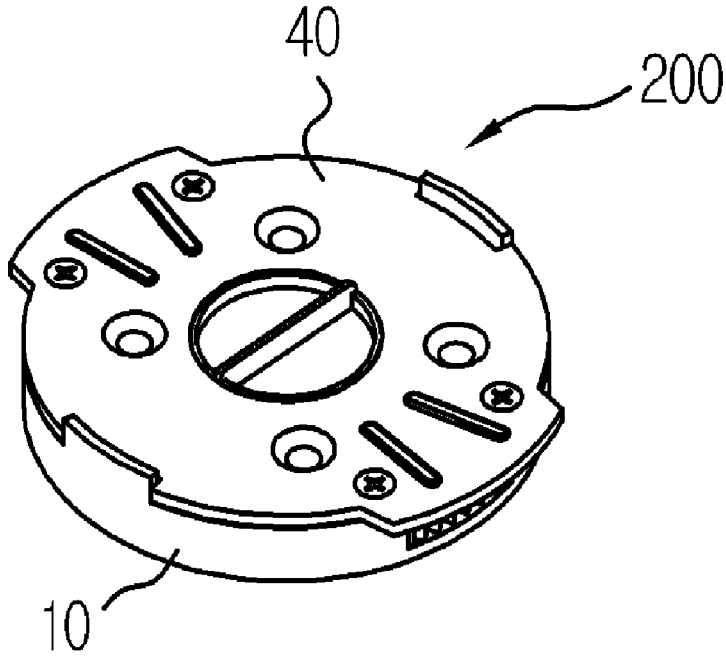

[Fig. 7]
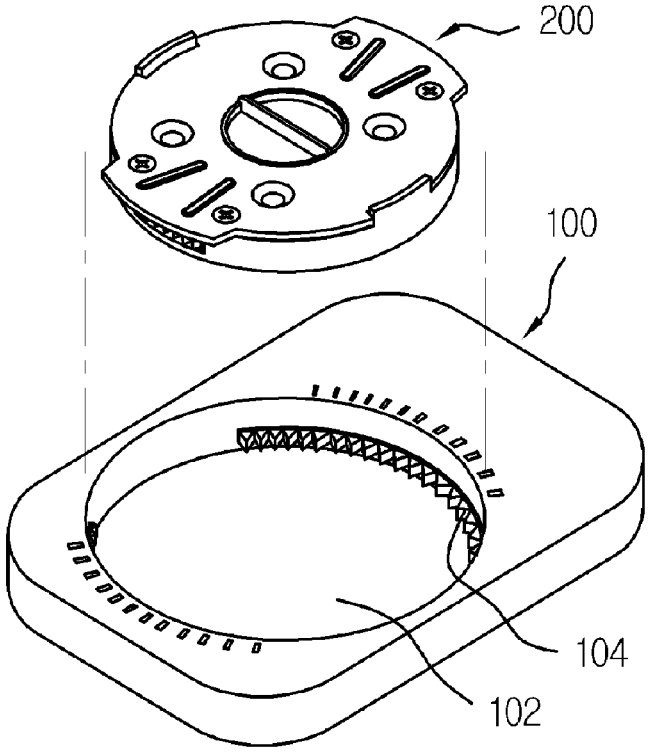
[Fig. 8]
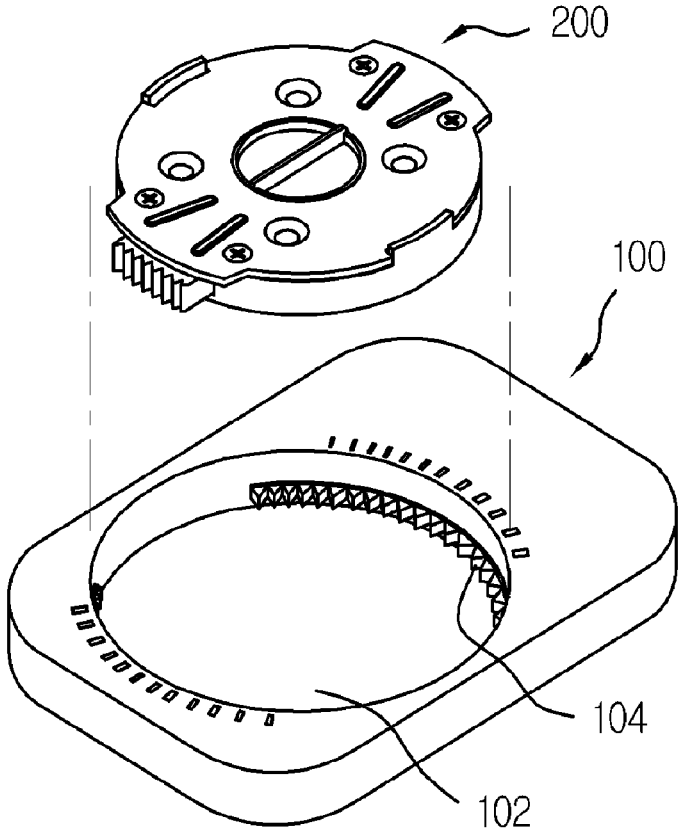

[Fig. 9]
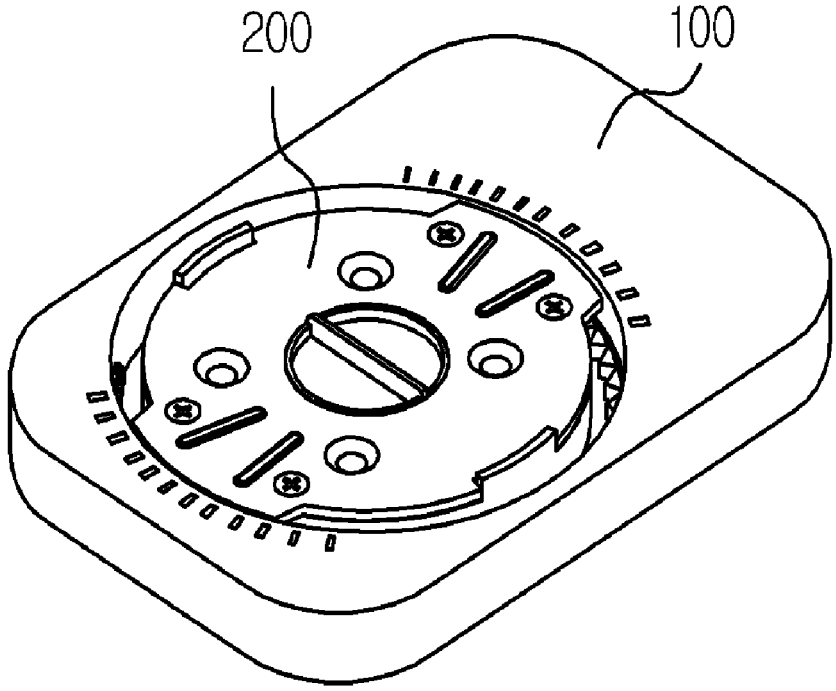
[Fig. 10]
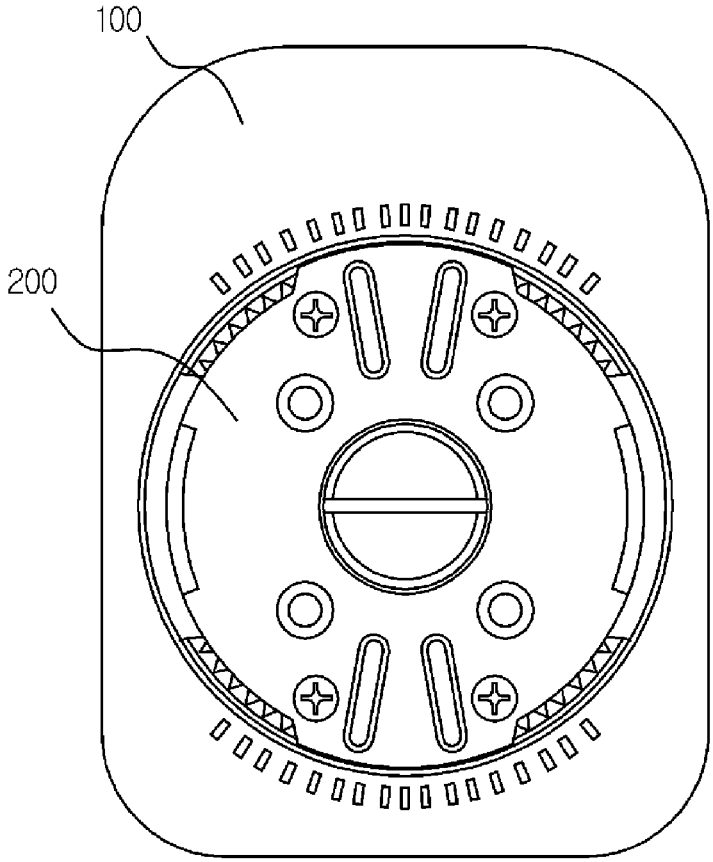

[Fig. 11]
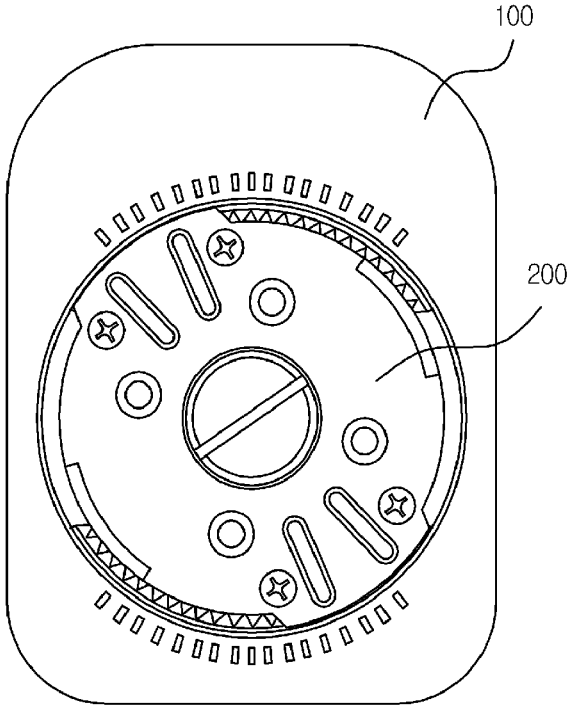
[Fig. 12]
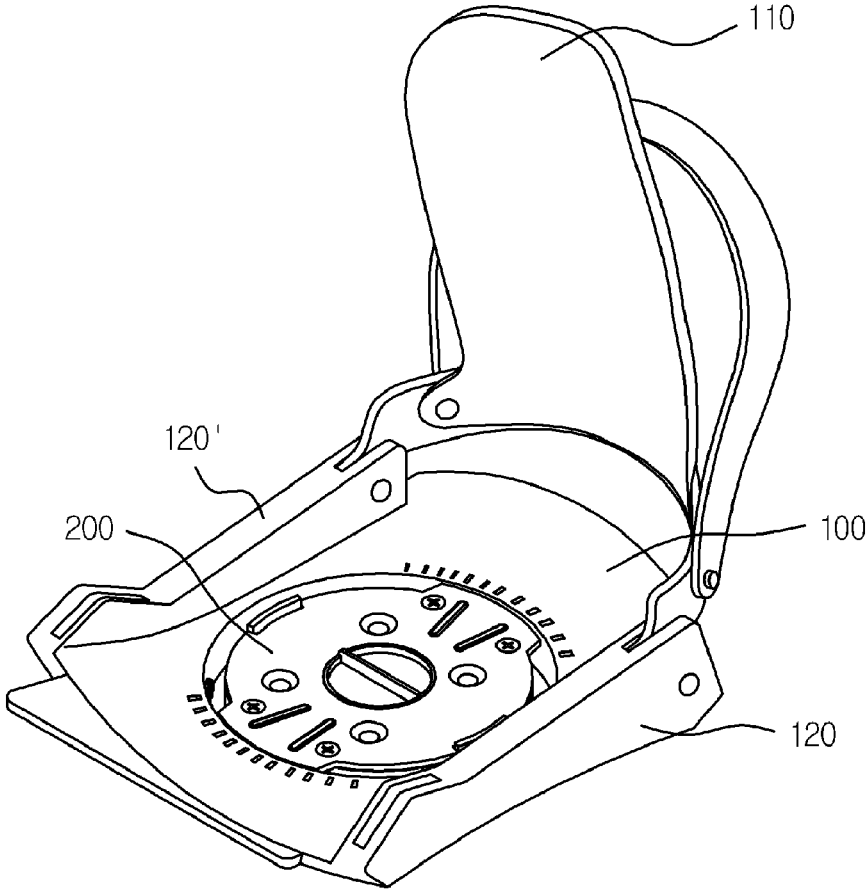

[Fig. 13]
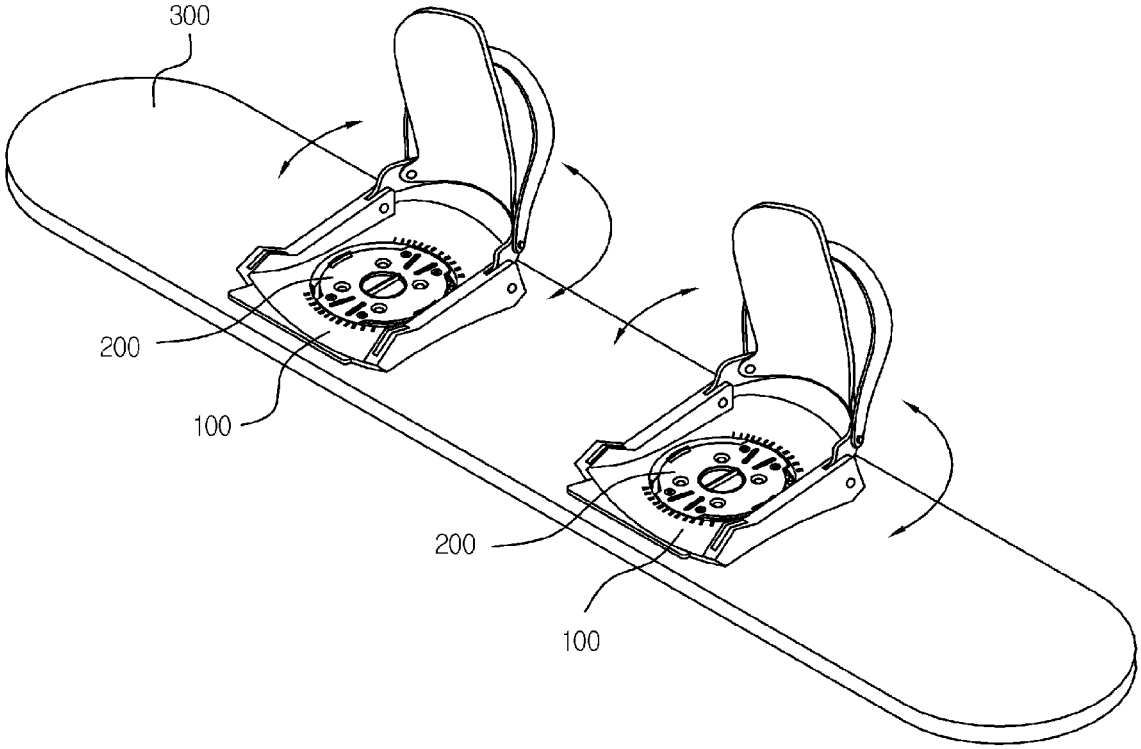

DISK FOR CONTROLLING AN ANGLE OF BINDING IN SNOWBOARD

RELATED APPLICATIONS

This application is a 371 application of International Application No. PCT/KR2008/001552, filed Mar. 19, 2008, which in turn claims priority from Korean Patent Application No. 10-2007-0058842, filed Jun. 15, 2007, both of which are incorporated herein by reference in their entirety.

TECHNICAL FIELD

The present invention relates to a disk for controlling the angle of a snowboard binding, and more particularly, to a disk for controlling the angle of a snowboard binding, wherein a base plate of the snowboard binding is formed at an inner periphery of a center opening thereof with a toothed gear, and the disk has disk gears formed at outer ends thereof with toothed gears, whereby the disk can be mounted in the base plate of the snowboard binding as the toothed gears of the disk gears of the disk are engaged with the toothed gear of the binding plate by a clockwise or counterclockwise rotation of a disk lever provided at the center of the disk, thereby acting to control the angle of the snowboard binding.

BACKGROUND ART

Snowboarding has a need for special motions and physical requirements not discovered in other sports including skiing. A person who rides a snowboard, i.e. snowboarder should stand on the snowboard only with his/her feet by use of devices used to safely attach the feet onto the snowboard. However, the attachment devices have a significant limit in strength and installation position thereof. It is noted that, when descending a snow-covered slope by snowboarding, a motive force to drive the snowboard is gravity. Therefore, the snowboarder needs to carefully guess the position of his/her body differently from other sports. In particular, it is noted that an angle between the center axis of each foot and the center axis of a snowboard greatly varies according to different snowboarders and various snowboarding tricks and descent techniques. Also, a boot set into a binding mounted on the snowboard is often used as a device to support the lower part of the leg right above the ankle. However, if the ankle at the center of the leg is changed in position relative to the snowboard, it may cause a change in an angle between the leg and the foot. Currently, there has been generally used a pair of rigid supporting devices vertically erected from a snowboard and aligned, respectively, with the center axes of both feet. The supporting devices are designed to be folded down onto a surface of the snowboard. Meanwhile, to assure a freedom in the implementation of various snowboarding motions, it is necessary to appropriately control the dismantling and remounting of bindings to and from a snowboard. Also, a distance between two bindings attached onto the snowboard and relative positions of the bindings on the basis of a longitudinal length of the snowboard should be changed according to snowboarders having different body sizes.

DISCLOSURE OF INVENTION

Technical Problem

Snowboarding has a need for special motions and physical requirements not discovered in other sports including skiing. A person who rides a snowboard, i.e. snowboarder should stand on the snowboard only with his/her feet by use of devices used to safely attach the feet onto the snowboard. However, the attachment devices have a significant limit in strength and installation position thereof. It is noted that, when descending a snow-covered slope by snowboarding, a motive force to drive the snowboard is gravity. Therefore, the snowboarder needs to carefully guess the position of his/her body differently from other sports. In particular, it is noted that an angle between the center axis of each foot and the center axis of a snowboard greatly varies according to different snowboarders and various snowboarding tricks and descent techniques. Also, a boot set into a binding mounted on the snowboard is often used as a device to support the lower part of the leg right above the ankle. However, if the ankle at the center of the leg is changed in position relative to the snowboard, it may cause a change in an angle between the leg and the foot. Currently, there has been generally used a pair of rigid supporting devices vertically erected from a snowboard and aligned, respectively, with the center axes of both feet. The supporting devices are designed to be folded down onto a surface of the snowboard. Meanwhile, to assure a freedom in the implementation of various snowboarding motions, it is necessary to appropriately control the dismantling and remounting of bindings to and from a snowboard. Also, a distance between two bindings attached onto the snowboard and relative positions of the bindings on the basis of a longitudinal length of the snowboard should be changed according to snowboarders having different body sizes.

Technical Solution

Therefore, the present invention has been made in view of problems represented by conventional disks for controlling the angle of a snowboard binding, and it is an object of the present invention to provide a disk for controlling the angle of a snowboard binding, wherein a base plate of the snowboard binding is formed at an inner periphery of a center opening thereof with a toothed gear, and the disk has disk gears formed at outer ends thereof with toothed gears, whereby the disk can be mounted in the base plate of the snowboard binding as the toothed gears of the disk gears of the disk are engaged with the toothed gear of the binding plate by a clockwise or counterclockwise rotation of a disk lever provided at the center of the disk, thereby acting to control the angle of the snowboard binding.

BRIEF DESCRIPTION OF THE DRAWINGS

The above and other objects, features and other advantages of the present invention will be more clearly understood from the following detailed description taken in conjunction with the accompanying drawings, in which:

FIG. 1 is an exploded perspective view illustrating a disk for controlling the angle of a snowboard binding according to the present invention;

FIG. 2 is an exploded perspective view schematically illustrating constituent elements of the disk according to the present invention;

FIG. 3 is an exploded perspective view illustrating a disk cover, a disk plate, and a disk lever included in the disk according to the present invention;

FIG. 4 is an exploded perspective view illustrating the disk cover and the disk plate after the disk lever is assembled with the disk plate;

FIG. 5 is an exploded perspective view illustrating the disk cover and the disk plate in a state wherein the disk lever is rotated to push disk gears outward;

FIG. 6 is a perspective view illustrating the assembled state of the disk cover and the disk plate;

FIG. 7 is an exploded perspective view illustrating the disk and a snowboard binding before the disk lever is rotated;

FIG. 8 is an exploded perspective view illustrating the disk and a snowboard binding after the disk lever is rotated;

FIG. 9 is a perspective view illustrating the assembled state of the disk and the snowboard binding;

FIG. 10 is a plan view illustrating the assembled state of the disk and the snowboard binding before the disk lever is rotated;

FIG. 11 is a plan view illustrating the assembled state of the disk and the snowboard binding after the disk lever is rotated;

FIG. 12 is a perspective view of the disk assembled with the snowboard binding; and FIG. 13 is a perspective view illustrating a state wherein a pair of snowboard bindings each having the disk according to the present invention are mounted on a snowboard.

MODE FOR THE INVENTION

Hereinafter, a preferred embodiment of the present invention will be described with reference to the accompanying drawings.

A disk for controlling the angle of a snowboard binding according to the present invention is configured to be mounted in a base plate 100 of the snowboard binding in such a manner that the disk is inserted into a center opening 102 of the binding plate 100, the center opening 102 being formed at an inner periphery thereof with a toothed gear 104. The disk for controlling the angle of the snowboard binding according to the present invention generally includes a circular disk plate 10, a disk lever 20, and a pair of disk gears 30 and 30'. The circular disk plate 10 is centrally formed with a solid lever fixing pole 12. Provided at both sides of the lever fixing pole 12 are disk-gear guide recesses 14 and 14'. The disk gears 30 and 30' will be inserted into the disk-gear guide recesses 14 and 14' such that they can move forward and rearward in the disk-gear guide recesses 14 and 14' according to a guiding direction of the disk lever 20. Provided also at another both sides of the lever fixing pole 12 are hook supporting pieces 16 and 16' to support hooks 34 and 34' of the disk gears 30 and 30'. Also, a lever supporting piece 18 is formed at the disk plate 10, to support any one of bottom bosses 24 and 24' formed at a bottom surface of the disk lever 20. The disk gears 30 and 30' are disposed in the disk-gear guide recesses 14 and 14' of the disk plate 10 such that they are coupled with the disk lever 20. More specifically, the disk gears 30 and 30' have stepped portions 32 and 32' formed at inner ends thereof, respectively, such that lateral protrusions 26 and 26' of the disk lever 20 are coupled with upper surfaces of the stepped portions 32 and 32'. The hooks 34 and 34' of the disk gears 30 and 30' are also formed at the inner ends of the disk gears 30 and 30' and are configured to be coupled with the bottom bosses 24 and 24'. The disk gears 30 and 30' also have toothed gears 36 and 36' formed at outer ends thereof, respectively. The disk lever 20 has a hollow fixing pole 22 formed at the center of the bottom surface thereof. The bottom bosses 24 and 24' are formed at both sides of the fixing pole 22. The lateral protrusions 26 and 26' are formed at an outer periphery of the disk lever 20 at opposite positions adjacent to the respective bottom bosses 24 and 24'. The disk lever 20 also has a rotating protrusion 28 formed at a top surface thereof.

In the present invention, the disk for controlling the angle of the snowboard binding further comprises a disk cover 40 configured to be mounted on the top of the disk plate 10 after the disk gears 30 and 30' and the disk lever 20 are assembled with the disk plate 10. The disk cover 40 has a center opening 42, and a plurality of bolt holes 44 through which bolts 50 are fastened to assemble the disk cover 40 and the disk plate 10 with each other.

As shown in FIGS. 6 to 8, to mount the disk for controlling the angle of the snowboard binding, which is designated as reference numeral 200, in the binding plate 100, the binding plate 100 is centrally formed with the opening 102 and in turn, the opening 102 is formed at the inner periphery thereof with the toothed gear 104. Referring to FIGS. 1 to 7, the circular disk plate 10 of the disk 200 according to the present invention can be mounted in the center opening 102 of the binding plate 100, and the lever fixing pole 12 formed at the center of the disk plate 10 can be fitted into the hollow fixing pole 22 of the disk lever 20 to keep the disk lever 20 at a fixed position. Referring to FIGS. 4 and 5, the disk gears 30 and 30' are mounted in the disk-gear guide recesses 14 and 14' formed at both sides of the lever fixing pole 12 such that they can be moved forward and rearward according to the guiding direction of the disk lever 20. Referring to FIG. 3, to prevent the disk gears 30 and 30' from being rotated after being coupled with the disk plate 10 of the disk 200 according to the present invention, the disk plate 10 has the hook supporting pieces 16 and 16' formed at both sides of the lever fixing pole 12 to support the hooks 34 and 34' of the disk gears 30 and 30'. Also, to prevent the disk lever 20 from being rotated after being coupled with the disk plate 10, the disk plate 10 has the lever supporting piece 18 to support any one of the bottom bosses 24 and 24' of the disk lever 20.

In the disk plate 10 of the disk 200 according to the present invention as shown in FIGS. 1 to 7, a spring mount 19 is defined between the hook supporting piece 16' and the lever supporting piece 18, and also, the hollow fixing pole 22 of the disk lever 20 is formed with a circumferential recess 28. With this configuration, as shown in FIGS. 3 and 4, a spring 60 is inserted into the spring mount 19 and a bead 62 is interposed between the spring 60 and the circumferential recess of the hollow fixing pole 22 of the disk lever 20. The use of the spring 60 and the bead 62 preferably has the effect of providing the disk plate 10 with a clearance required when the disk lever 20 is rotated clockwise or counterclockwise.

As shown in FIGS. 1 to 7, the disk gears 30 and 30' of the disk 200 according to the present invention are disposed in the disk-gear guide recesses 14 and 14' of the disk plate 10. Also, as shown in FIGS. 4 and 5, the disk gears 30 and 30' are formed at the inner ends thereof with the stepped portions 32 and 32'. With this configuration, when the disk lever 20 is rotated clockwise or counterclockwise, the lateral protrusions 26 and 26' of the disk lever 20 are coupled with the upper surfaces of the stepped portions 32 and 32', thereby acting to push the disk gears 30 and 30' outward. Then, if the disk lever 20 is rotated clockwise or counterclockwise after the hooks 34 and 34' of the disk gears 30 and 30' formed at positions adjacent to the stepped portions 32 and 32' are coupled with the bottom bosses 24 and 24' of the disk lever 20, the disk gears 30 and 30' are returned inward to their original positions. Referring to FIGS. 10 and 11, as the completely assembled disk lever 20 of the disk 200 according to the present invention is rotated clockwise or counterclockwise, the toothed gears 36 and 36' formed at the outer ends of the disk gears 30 and 30' are engaged with the toothed gear 104 formed at the inner periphery of the center opening 102 of the binding plate 100, to allow the angle of the snowboard binding to be controlled by the disk 200.

Referring again to FIGS. 1 to 7, the disk lever 20 of the disk 200 according to the present invention can be coupled with the disk plate 10 as the lever fixing pole 12 formed at the center of the disk plate 10 is fitted into the hollow lever fixing pole 22 formed at the center of the disk lever 20. The bottom bosses 24 and 24' are formed at both sides of the lever fixing pole 22, and the lateral protrusions 26 and 26' are formed at the outer periphery of the disk lever 20 at positions adjacent to the bottom bosses 24 and 24'. Also, the rotating protrusion 28 is formed at the top surface of the disk lever 20. As shown in FIGS. 1 to 6, to assemble the disk 200 according to the present invention, after the disk gears 30 and 30' and the disk lever 20 are coupled with the disk plate 10, the disk cover 40 having the center opening 42 is disposed on the top of the disk plate 10 and finally, the bolts 50 are fastened through the bolt holes 44 of the disk cover 40.

To use a snowboard provided with the disk 200 for controlling the angle of the snowboard binding according to the present invention, first, the disk 200 is mounted in the binding plate 100 by use of the toothed gear 104 of the binding plate 100, and then, the snowboarder's foot set into a boot can be fixed on the snowboard binding. In this casa, if a rotating angle of the disk lever 20 as a direction control device is not limited, it may cause injury to the snowboarder's leg including the ankle. To eliminate this risk of injury, the toothed gear 104 of the binding plate 100 and the toothed gears 36 and 36' of the disk gears 30 and 30' constitute an angle adjusting device. Specifically, the toothed gears 36 and 36' of the disk gears 30 and 30' can be engaged with the toothed gear 104 of the binding plate 100 such that the rotating angle of the disk lever 20 as the direction control device can be set to a desired angle.

If the snowboarder rotates his/her feet to be aligned straightly with the binding plate 100 in order to turn the snowboard to the left, a toe edge of the snowboard is turned to the left. In this case, in order to prevent the snowboarder's feet from being rotated excessively to the left, the angle adjusting device has a function of limiting a leftward rotating angle. In this way, the snowboarder can freely and safely turn the snowboard to the left or the right. Then, when it is desired to stop the snowboard, the snowboarder can easily brake the snowboard by positioning the feet approximately perpendicular to the binding plate 100. With this positioning of the feet, a heel edge of the snowboard is turned to the front, thereby accomplishing the braking of the snowboard. When the snowboarder is stopping on the flat ground or gentle slope, the snowboarder can stably stand without the risk of slippage by positioning the feet approximately perpendicular to the binding plate 100. Then, the snowboarder can again move the snowboard by simply aligning the feet straightly with the binding plate 100.

The angle-adjusting disk 200 for the snowboard binding of the present invention is designed to be mounted to a snowboard boot binding system, and is mounted on and supported by the snowboard while being coupled in the binding plate 100. In the present invention, the binding plate 100 has the center opening 102 for the installation of the circular disk plate 10 of the disk 200. Once the snowboarder selects a desired rotating position, the disk 200 of the present invention can be secured onto the snowboard, together with the binding plate 100, at a position freely selected by the snowboarder. In the present invention, a high-back leg supporting member 110 is attached to a rear end of the binding plate 100. The high-back leg supporting member 110 is pivotally rotatable about an axis perpendicular to the binding plate 100, to transmit a force applied from the snowboarder's leg to the snowboard. Once being pivotally rotated, the high-back leg supporting member 110 can be kept at the rotated position.

FIG. 13 illustrates a snowboard having the snowboard binding system according to the present invention. In use, the snowboarder can ride the snowboard 300 while putting his/her feet on the snowboard 300 such that a center axis of each foot, i.e. a line extending from the heel to the tip toe has a predetermined angle with a center axis of the snowboard 300. In this case, due to different foot sizes and displacement angles relative to the center axis of the snowboard 300, every snowboarder has a slight difference in the angle between the foot and the shin from the ankle to the knee. Accordingly, in due consideration of different body sizes of snowboarders who ride the snowboard, the foot, more preferably wearing a boot, and the shin can be supported by the snowboard binding according to the angle of the snowboard binding. In FIG. 13, the base plate 100 of the snowboard binding disposed on the top of the snowboard 300 is illustrated. The snowboard binding further includes both sidewalls 120 and 120', and a heel supporting wall extended from the sidewalls 120 and 120' and disposed on the heel portion of the binding plate 100. The heel supporting wall is curved to be appropriately expanded outward to surround the heel portion of the base plate 100.

In the present invention, the binding plate 100 can be attached to the snowboard 300 in such a manner that the toothed gears 36 and 36' of the disk 200 are engaged with the toothed gear 104 formed at the center opening 102 of the binding plate 100. By virtue of the above described various configurations, the binding plate 100 can be freely moved along the center axis of the snowboard 300, and also, can be freely pivotally rotated about an axis perpendicular to the snowboard in both lateral directions of the snowboard. Also, the high-back leg supporting member 100 can be freely pivotally rotated away from the binding plate 100 to an axis perpendicular to the snowboard 300 or vice versa. The above described configurations of the binding plate 100 and the disk 200 according to the present invention provide a great allowance in several adjustments, for example, in the adjustment of the position of a snowboard binding between front and rear ends of the snowboard and between both side edges of the snowboard, the adjustment of a distance between a pair of snowboard bindings, and the adjustment of the rotating position of the snowboard binding.

INDUSTRIAL APPLICABILITY

As apparent from the above description, the present invention provides a disk for controlling the angle of a snowboard binding, which can be mounted to a base plate of the snowboard binding as toothed gears thereof are engaged with a toothed gear formed at an inner periphery of a center opening of the base plate when a disk lever provided at the center of the disk is rotated clockwise or counterclockwise. The disk for controlling the angle of the snowboard binding according to the present invention has the effects of allowing a person who is riding a snowboard to easily control the angle of the snowboard binding if necessary, reducing the manufacturing costs of products, and assuring easy repair and maintenance of products with a low risk of failure.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

The invention claimed is:

1. A disk for adjusting the angle of a snowboard binding, the snowboard binding including a center opening formed at an inner periphery thereof with a toothed gear, the disk comprising: a circular disk plate; a pair of disk gears; and a disk lever, wherein the disk plate has a lever fixing pole provided at the center thereof, disk-gear guide recesses formed at both sides of the lever fixing pole to allow the disk gears to be moved forward and rearward in the guide recesses according to a guiding direction of the disk lever, hook supporting pieces provided also at another both sides of the lever fixing pole to support hooks of the disk gears, and a lever supporting piece to support any one of bottom bosses formed at a bottom surface of the disk lever, wherein the disk gears are mounted in the disk-gear guide recesses of the disk plate and have stepped portions formed at inner ends thereof, respectively, to allow lateral protrusions of the disk lever to be coupled with upper surfaces of the stepped portions, the hooks being also formed at the inner ends of the disk gears so as to be coupled with the bottom bosses of the disk lever, and toothed gears formed at outer ends thereof, respectively, wherein the disk lever has a rotating protrusion formed at a top surface thereof and a fixing pole formed at the center of the bottom surface thereof, the bottom bosses being formed at both sides of the fixing pole, and the lateral protrusions being formed at an outer periphery of the disk lever at opposite positions adjacent to the respective bottom bosses, and wherein the disk is mounted in the base plate of the snowboard binding to control the angle of the snowboard binding after the disk gears and the disk lever are assembled with the disk plate.

2. The disk according to claim 1, further comprising:

a disk cover to be mounted on the top of the disk plate after the disk gears and the disk lever are assembled with the disk plate, the disk cover having a center opening, and a plurality of bolt holes to fasten the disk cover with the disk plate by means of bolts.

* * * * *